US006014114A

United States Patent [19]

Westfall et al.

[11] Patent Number: 6,014,114

[45] **Date of Patent: *Jan. 11, 2000**

[54] ANTENNA WITH STEPPED GROUND PLANE

[75] Inventors: Brian G. Westfall; Kevin B. Stephenson, both of Mountain View, Calif.

[73] Assignee: Trimble Navigation Limited, Sunnyvale, Calif.

[ * ] Notice: This patent is subject to a terminal disclaimer.

[21] Appl. No.: 08/934,249

[22] Filed: Sep. 19, 1997

[51] Int. Cl.[7] ..... H01Q 1/48

[52] U.S. Cl. ..... 343/846; 343/848; 343/829; 343/700 MS

[58] Field of Search ..... 343/700 MS, 846, 343/848, 829; H01Q 1/48

[56] References Cited

U.S. PATENT DOCUMENTS 4,887,089 12/1989 Shibata et al. ..... 343/700 MS
5,121,127 6/1992 Toriyama ..... 343/700 MS
5,124,733 6/1992 Haneishi ..... 343/846
5,170,175 12/1992 Kobus et al. ..... 343/700 MS
5,694,136 12/1997 Westfall ..... 343/700 MS

*Primary Examiner*—David H. Vu
*Assistant Examiner*—Hoang Nguyen
*Attorney, Agent, or Firm*—Cooper & Dunham LLP; Donald S. Dowden, Esq.

[57] ABSTRACT

An antenna structure has a radiating element and a ground plane. The ground plane has a central region relatively closely spaced apart from the radiating element and a peripheral region extending away from the central region. The peripheral region comprises at least one conductive layer that extends radially beyond the radiating element and provides a sheet resistivity higher than that of the radiating element. Though physically small, the ground plane simulates an infinite ground plane, and the antenna structure reduces multipath signals caused by reflection from the earth.

50 Claims, 12 Drawing Sheets

ANTENNA WITH STEPPED GROUND PLANE

CROSS REFERENCE TO RELATED APPLICATIONS

This application is related to U.S. application Ser. No. 08/614,546, filed Mar. 13, 1996, now U.S. Pat. No. 5,694,136 and Ser. No. 08/934,416 [attorney docket No. 7284/53653], filed concurrently herewith. Both related applications are assigned to the assignee of the present application.

BACKGROUND OF THE INVENTION

1. Field of the Invention

This invention relates to antenna structures and more particularly to a novel and highly effective antenna structure comprising a radiating element such as a patch antenna in combination with a ground plane constructed to enhance antenna performance.

2. Description of the Prior Art

There is a need for an improved antenna structure for use with a GPS receiver that receives and processes signals from navigation satellites. Antenna structures known heretofore that are capable of optimum performance are too bulky and unwieldy for use in small GPS receivers, especially hand-held receivers. Compact antenna structures that are conventionally employed with GPS receivers do not provide optimum performance. One problem is that they receive signals directly from satellites and, because of ground reflections, also indirectly. This so-called multipath reception causes time measurement errors that can lead to a geographical fix that is erroneous or at least suspect.

A British patent publication No. 2,057,773 of Marconi discloses a large radio transmitting antenna including aerial wires supported in spaced, parallel relation by posts. The ground around the antenna is saturated to a depth of two or three meters with an aqueous solution of calcium sulfate to increase the conductivity of the ground and thereby improve its reflectivity. The ground is permeated to a distance two to three times as far from the antenna as the antenna is tall. In a typical case this can be from 50 to 100 meters from the boundaries of the antenna array.

A European patent publication No. 394,960 of Kokusai Denshin Denwa discloses a microstrip antenna having a radiation conductor and a ground conductor on opposite sides of a dielectric substrate. The spacing between the radiation conductor and the ground conductor, or the thickness of the dielectric substrate, is larger at the peripheral portion of those conductors than at the central portion. Because of the large spacing at the peripheral portion, the impedance at the peripheral portion where electromagnetic waves are radiated is said to be close to the free-space impedance.

A German patent publication No. DE 37 38 513 and its U.S. counterpart patent No. 5,061,938 to Zahn et al. disclose a microstrip antenna including an electrically conductive base plate carrying an electrically insulating substrate on top of which are a plurality of radiating patches. A relatively large spacing is established between the electrically insulating substrate and the base plate at lateral dimensions somewhat larger than lateral dimensions of the patches and also in the vicinity of the patches. The patches and spacings are vertically aligned through either local elevations of the insulating substrate or local indentations in the base plate. The feeder line is thus relatively close to the conductive base plate, and the radiating patch is farther away from the conductive base plate. This is said to improve the radiating characteristics of the patch.

A German patent publication No. DE 43 26 117 of Fischer discloses a cordless telephone with an improved antenna.

A European patent publication No. 318,873 of Toppan Printing Co., Ltd., and Seiko Instruments Inc. discloses an electromagnetic-wave-absorbing element comprising an elongate rectangular body of dielectric material having a bottom portion attachable to an inner wall of an electromagnetically dark room, and peripheral elongate faces extending vertically from the bottom portion. A set of the absorbing elements can be arranged in rows and columns on the wall. An electroconductive ink film is formed on the peripheral faces of the body and has a gradually changing surface resistivity decreasing exponentially lengthwise of the peripheral face toward the bottom portion. The incident electromagnetic wave normal to the wall provided with the rows and columns of absorbing elements is absorbed by a lattice of the electroconductive film during the travel along the electroconductive film. In order to avoid reflection of an incident electromagnetic wave at the boundary between the surrounding air and the absorbing element, the characteristic impedance at the top of the element through which the incident wave enters is close to the impedance of air. In order to avoid reflection at the boundary between the bottom of the element and the wall to which it is attached, the characteristic impedance at the bottom is close to that of the wall. The absorbing element is made of a plastic body with an electroconductive covering and having a variable resistivity or conductivity.

The following prior art is also of interest: U.S. Pat. Nos. 5,592,174 to Nelson for GPS Multi-Path Signal Reception, Raguenet U.S. Pat. No. 5,248,980 for Spacecraft Payload Architecture, Franchi et al. U.S. Pat. No. 5,204,685 for ARC Range Test Facility, Kobus et al. U.S. Pat. No. 5,170,175 for Thin Film Resistive Loading for Antennas, De et al. U.S. Pat. No. 5,132,623 for Method and Apparatus for Broadband Measurement of Dielectric Properties, Hong et al. U.S. Pat. No. 4,965,603 for Optical Beamforming Network for Controlling an RF Phased Array, Schoen U.S. Pat. No. 4,927,251 for Single Pass Phase Conjugate Aberration Correcting Imaging Telescope, and Bhartia et al. U.S. Pat. No. 4,529,987 for Broadband Micropstrip Antennas with Varactor Diodes.

The prior art as exemplified by the patents discussed above does not disclose or suggest an ideal antenna structure for use in a GPS receiver that receives and processes signals from navigation satellites. What is needed in such an environment is an antenna structure that is very light and portable and adapted to hand-held units of the type used, for example, by surveyors.

OBJECTS AND SUMMARY OF THE INVENTION

An object of the invention is to overcome the problems of the prior art noted above and in particular to provide an antenna structure that reduces multipath signals caused by reflection from the earth, that is physically small yet simulates an infinite ground plane, and that is particularly adapted for use in a GPS receiver that receives and processes signals from navigation satellites. Another object of the invention is to provide an antenna structure that is suitable for hand-held units of the type used by surveyors.

In accordance with one aspect of the invention, there is provided an antenna structure comprising a radiating element and a ground plane for the radiating element having a central region closely spaced apart from the radiating element and a peripheral region extending away from the central region. The peripheral region comprises a conductive layer that provides a sheet resistivity higher than that of the radiating element and extends radially beyond the radiating element.

In accordance with another aspect of the invention, there is provided an antenna structure comprising a radiating element and a ground plane for the radiating element having a central region relatively closely spaced apart from the radiating element and a peripheral region extending away from the central region. The peripheral region comprises a first conductive layer that provides a sheet resistivity of a first value and a second conductive layer that extends radially beyond the first conductive layer to provide a sheet resistivity of a second value higher than the first value. The conductive layers may but need not overlap. Also, the number of conductive layers can vary from one upwards to any intergeer.

In accordance with an independent aspect of the invention, there is provided a method comprising the steps of forming an antenna structure comprising a radiating element for receiving broadcast signals directly and, because of reflection of the signals, also indirectly with a time delay, and a ground plane. The ground plane has a central region relatively closely spaced apart from the radiating element and a peripheral region extending away from the central region. The peripheral region comprises a conductive layer that provides a sheet resistivity higher than that of the radiating element. The antenna structure is employed to receive the broadcast signals. The signals received indirectly because of reflection are attenuated.

Preferably, an antenna structure in accordance with the invention is characterized by a number of additional features: the radiating element is a patch antenna, the radiating element and the ground plane have the same shape (both square, both circular, both octagonal, etc.), and the radiating element is centered over the ground plane (it is also within the scope of the invention, however, for the radiating element and the ground plane to have dissimilar shapes).

The ground plane has minimum linear resistivity adjacent the central region and maximum linear resistivity at the outer edge of the peripheral region. The ground plane can be planar, frustoconical and concave up or down, or frustopyramidal and concave up or down. The ground plane comprises a conductive portion in the central region, for example a disk made of or coated with aluminum.

The ground plane ideally has a sheet resistivity substantially in the range of 0 to 3 ohms per square measured from dead center to a position adjacent the periphery of the radiating element and a sheet resistivity of substantially 500–800 ohms per square measured at the periphery of the ground plane. The sheet resistivity of the peripheral region thus exceeds that in the central region by several orders of magnitude, whereby the ground plane, though physically small, simulates an infinite ground plane.

In the preferred method of practicing the invention, the received electromagnetic signals are GPS signals broadcast by navigation satellites.

BRIEF DESCRIPTION OF THE DRAWING

A better understanding of the objects, features and advantages of the invention can be gained from a consideration of the following detailed description of the preferred embodiments thereof, wherein like reference characters represent like elements or parts, and wherein.

DESCRIPTION OF THE PREFERRED EMBODIMENTS

Figure 1:
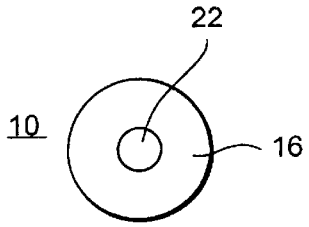
FIG. 1 is a top schematic view of a first embodiment of an antenna structure in accordance with the invention.
Figure 2:
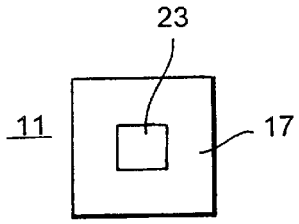
FIG. 2 is a top schematic view of a second embodiment of an antenna structure in accordance with the invention.
Figure 3:
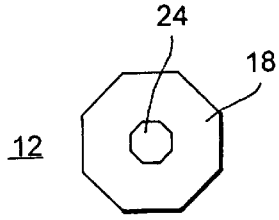
FIG. 3 is a top schematic view of a third embodiment of an antenna structure in accordance with the invention.

FIGS. 1–3 are top schematic views of antenna structures 10–12 including ground planes 16–18 and radiating elements 22–24; constructed in accordance with the invention; FIGS. 4, 4A, 5, 6 and 6A respectively show ground planes 19–21 and radiating elements 25–27 having other features that can be incorporated in antenna structures in accordance with the invention.

Figure 4:
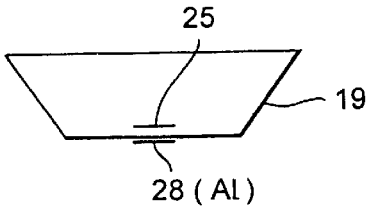
FIGS. 4, 5 and 6 are side sectional schematic views respectively showing embodiments of concave up, planar, and concave down ground planes, each of which can have any of the shapes in plan view shown in FIGS. 1–3.
Figure 4A:
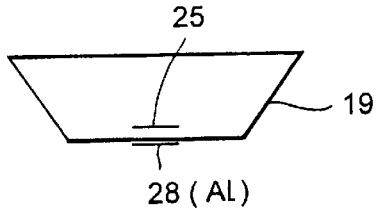
FIG. 4A and 6A are views similar to FIGS. 4 and 6, respectively, showing other embodiments of the invention.
Figure 5:
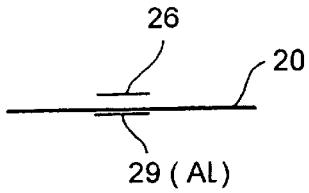
Figure 6:
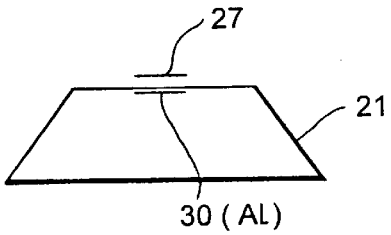
Figure 6A:
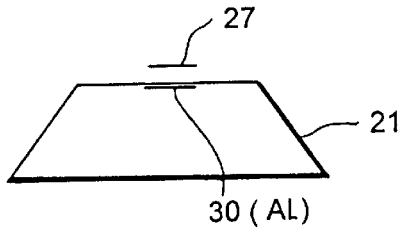

In FIG. 1, the antenna structure 10 comprises a ground plane 16 and a radiating element 22. Both the ground plane 16 and the radiating element 22 are circular. In FIG. 2 both (17, 23) are square; and in FIG. 3 both (18, 24) are octagonal. In each of FIGS. 1–3 the ground planes 16, 17, 18 are illustrated as planar, but, as FIGS. 4, 4A, 6 and 6A illustrate, they need not be. In FIG. 4, the ground plane 19 is frustoconical and concave up, and in FIG. 6 the ground plane 21 is frustoconical and concave down. In FIGS. 4A and 6A the ground planes are frustopyramidal and concave respectively up and down. In FIG. 5 the ground plane 20 is planar. The ground plane can have any of the shapes illustrated in FIG. 1–3—circular, square or octagonal—combined with any of the shapes illustrated in FIGS. 4, 4A, 5, 6 and 6A. Other shapes both in plan view and in side section are also within the scope of the invention, as those skilled in the art will readily understand.

Figure 8:
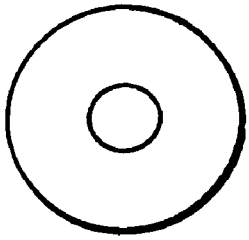
FIGS. 7–10 are top views of respective embodiments of the invention wherein the radiating element and the ground plane have dissimilar shapes.
Figure 7:
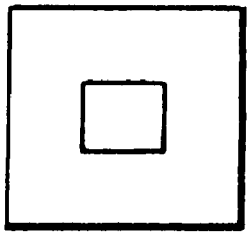
Figure 9:
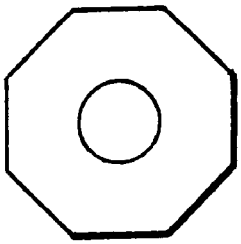
Figure 10:
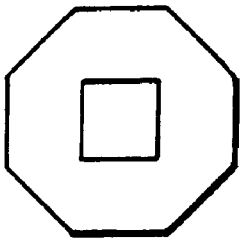

FIGS. 7–10 show embodiments of the invention wherein the radiating element and the ground plane have dissimilar shapes: respectively round/square in FIG. 7, square/round in FIG. 8, round/octagonal in FIG. 9, and square/octagonal in FIG. 10. Other combinations of dissimilar shapes will readily occur to those skilled in the art in light of this disclosure.

While the radiating element used in many applications is preferably a patch, other radiating elements including a quadri filar helix or four-armed spiral on a cylindrical or conical (or frustoconical) support base are well known in the art and can be used in appropriate cases. In a quadri filar helix, typically each spiral arm is fed by a power divider with an integral phase shifter to give each arm a successive 90-degree shift (to 0°, 90°, 180°, and 270°).

At the center of the ground plane there is a conductive portion, which can be formed of a metal such as aluminum or of a nonconductive material such as a woven cloth or a plastic disk impregnated with, or having a coating of, aluminum, another metal, or another conductive material. Aluminum plates 28–30 are illustrated in FIGS. 4, 4A, 5, 6 and 6A (an aluminum plate is of course highly conductive). The aluminum plate has an outer diameter of, say, 5 inches (about 13 cm).

In accordance with the invention, the ground plane has an outer diameter of, say, 13 inches (about 33 cm).

Sheet resistivity is measured in ohms per square. Consider a sheet of homogeneous material of uniform thickness in the shape of a square having a potential applied across it from one edge to the opposite edge. The current that flows is independent of the size of the square. For example, if the size of the square is doubled, the current must flow through double the length of the material, thereby doubling the resistance offered by each longitudinal segment of the square (i.e., each segment extending from the high-potential side of the square to the low-potential side). On the other hand, doubling the size of the square in effect adds a second resistor in parallel to the first and identical to it, thereby reducing the resistance by half. The change in resistance caused by doubling the size of the square is therefore $2\times0.5=1$. In other words, changing the size of the square does not affect the resistance offered by the square.

In contrast, the effective sheet resistivity varies in accordance with the present invention. The ground plane in the preferred embodiment of the invention has a sheet resistivity substantially in the range of 0 to 3 ohms per square measured from dead center to a position adjacent the periphery of the radiating element and a resistivity of substantially 500–800 ohms per square measured at the periphery of the ground plane. The resistivity of the peripheral region thus exceeds that in the central region by several orders of magnitude, whereby the ground plane, through physically small, simulates an infinite ground plane.

The sheet resistivity of free space is 377 ohms per square. The sheet resistivity of the ground plane at the outer periphery is thus much higher than that of free space.

The change in sheet resistivity of the ground plane, or of the ground plane/radiator assembly, is in discrete steps. This can be accomplished by varying the thickness of the resistive sheet, by changing its composition, and in other ways.

Figure 11:
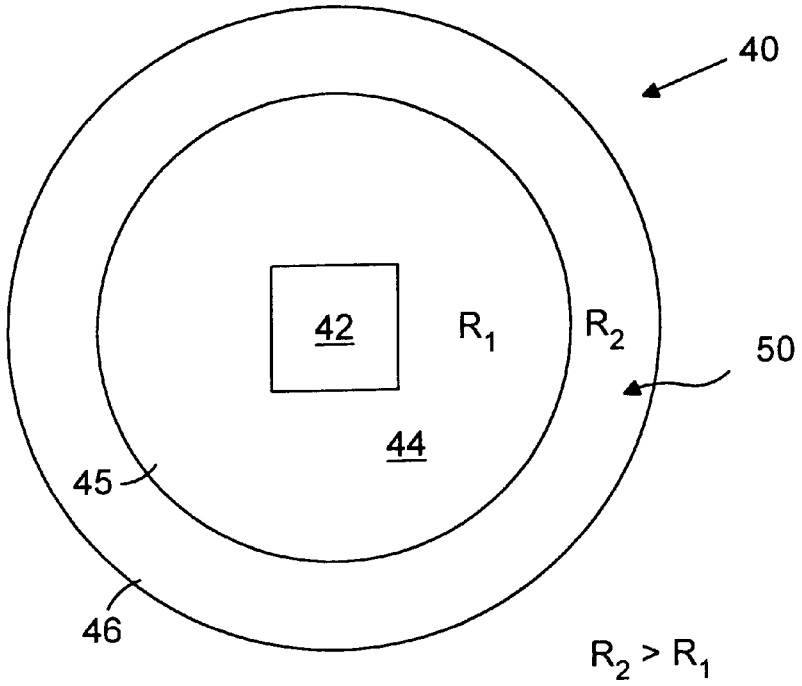
FIG. 11 is a top view showing in more detail a preferred embodiment of an antenna structure in accordance with the invention.
Figure 11A:
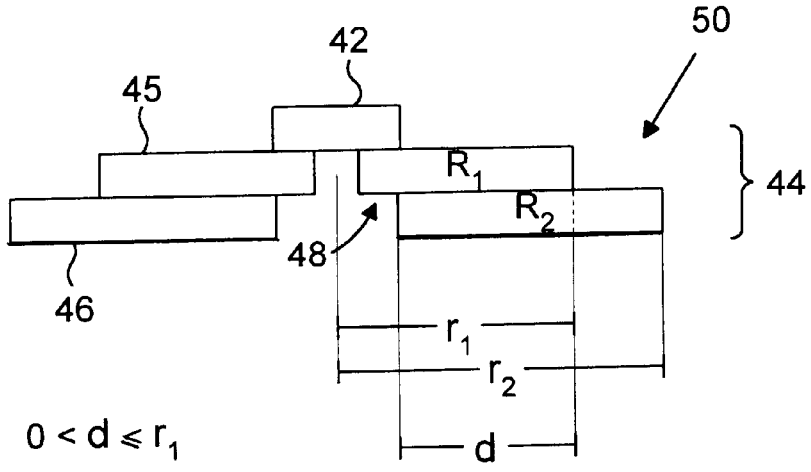
FIG. 11A is a side sectional view of the antenna structure of FIG. 11.

FIGS. 11 and 11A show antenna structure 40 constructed in accordance with the invention. It comprises a radiating element 42 and a ground plane 44 having first and second conductive layers 45 and 46. The radiating element 42 has, of course, a low sheet resistivity. The first conductive layer 45, forming part of the ground plane, has a central region 48 which is closely spaced apart from the radiating element 42. The peripheral region 50 extends away from the central region 48. The peripheral region 50 comprises at least the radially outer portion of the conductive layer 45 and provides a sheet resistivity higher than that of the radiating element 42. As FIGS. 11 and 11A show, the peripheral region 50 extends radially beyond the radiating element 42.

The structure described above (radiating element 42 of low sheet resistivity and first conductive layer 45 of high sheet resistivity) is sufficient to accomplish the objects of the invention. Preferably, however, at least a second conductive layer 46 is also provided. The second conductive layer 46 extends radially beyond the first conductive layer 45 to provide a sheet resistivity of a second value higher than the sheet resistivity of the conductive layer 45. The sheet resistivity of a second value higher than the sheet resistivity of the ground plane thus increases in steps as radial distance from the center increases.

As FIG. 11A shows, the conductive layers 45, 46 in part overlap. The overlapping portions have increased total thickness, and therefore the sheet resistivity is reduced. It is also within the scope of the invention, however, to arrange the conductive layers so they do not overlap one another. In this case, the material or thickness of the conductive layers is varied in order to provide step increases in sheet resistivity with increasing radial distance.

In FIGS. 11 and 11A, the first conductive layer 45 has a radius $r_1$ and a sheet resistivity $R_1$, and the second conductive layer 46 has a radius $r_2$ and a sheet resistivity $R_2$, where $r_2$ is greater than $r_1$, and $R_2$ is greater than $R_1$. The overlapping portion of the conductive sheets 45 and 46 extends over a radial distance d, where d is greater than 0 and equal to or less than $r_1$.

Figure 11B:
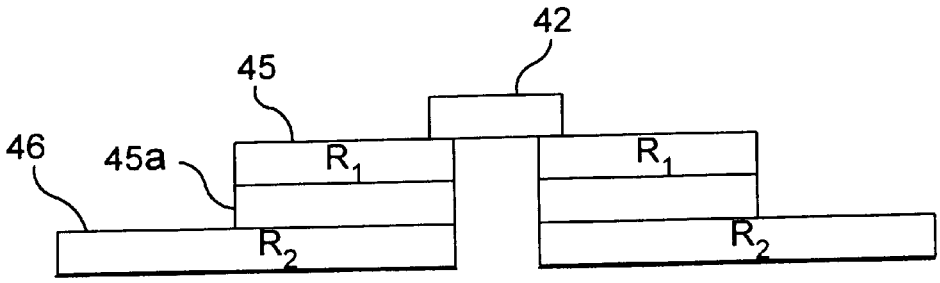
FIGS. 11B an 11C correspond to FIG. 11A but shows an alternative structure.
Figure 11C:
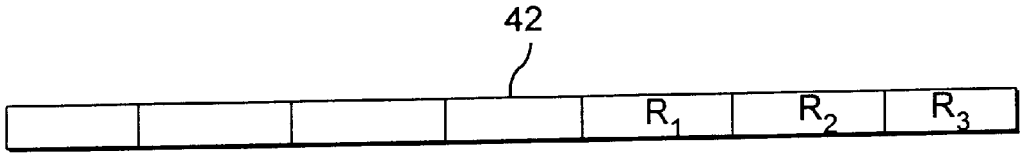

A separating layer 45*a* can be provided between the conductive layers 45 and 46, as indicated in FIG. 11B. The separating layer 45*a* can be conductive or nonconductive and made of a suitable material such as a plastic. It can also be adhesive. All of the resistive layers can be in a plane as in FIG. 11C.

Figure 12:
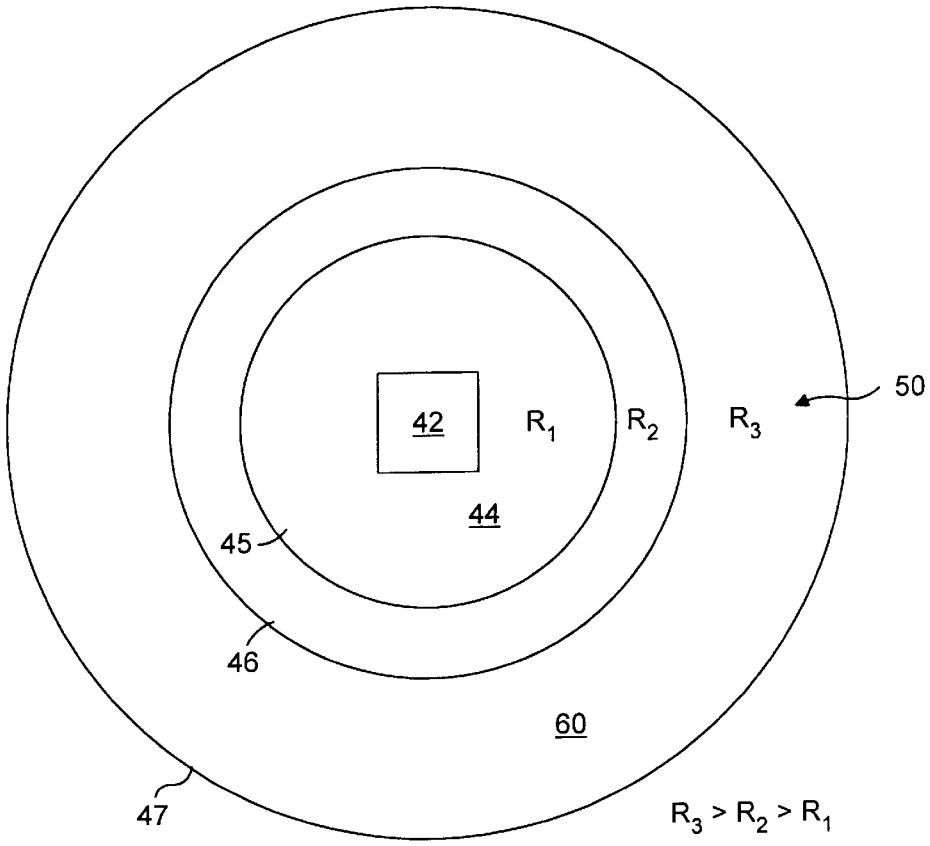
FIG. 12 is a top view of another embodiment of antenna structure in accordance with the invention.
Figure 12A:
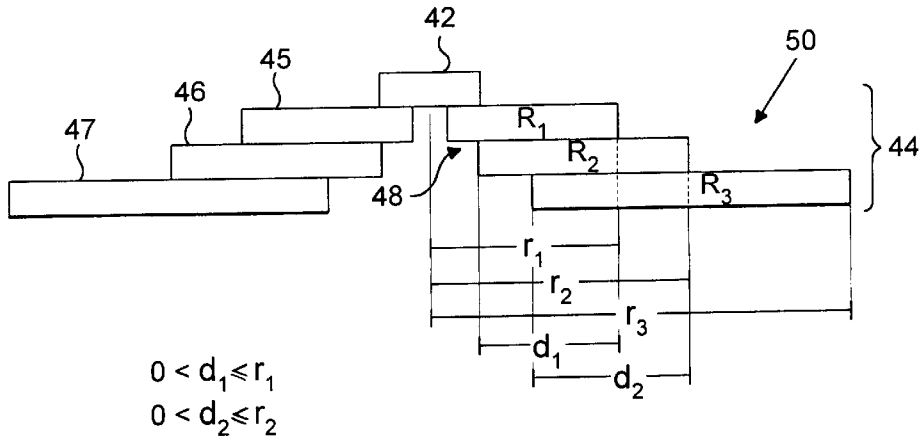
FIG. 12A is a side sectional view of the antenna structure of FIG. 12.

FIGS. 12 and 12A show an antenna structure comprising a radiating element 42, a ground plane 44 for the radiating element having a central region 48 closely spaced apart from the radiating element, and a peripheral region 50 extending away from the central region. The peripheral region 50 comprises first, second and third conductive layers 45, 46, 47 that in part overlap to provide a sheet resistivity of a first value. Individually, the layers 45, 46 and 47 have sheet resistivities $R_1$, $R_2$, $R_3$, where each of $R_1$, $R_2$, and $R_3$ is a constant, $R_2$ is greater than $R_1$, and $R_3$ is greater than $R_2$. The second and third conductive layers 46 and 47 extend radially beyond the first conductive layer 45 and overlap to provide a sheet resistivity of a second value higher than the first value. The third conductive layer 47 extends radially beyond the second conductive layer 46 to provide a sheet resistivity of a third value higher than the second value. FIG. 12A shows radii $r_1$, $r_2$ and $r_3$ of the conductive layers 45, 46 and 47, and the overlaps $d_1$ between the first and second conductive layers 45, 46 and $d_2$ between the second and third conductive layers 46 and 47. The value of $d_1$ is greater than zero and equal to or less than $r_1$. The value of $d_2$ is greater than zero and equal to or less than $r_2$.

Figure 12B:
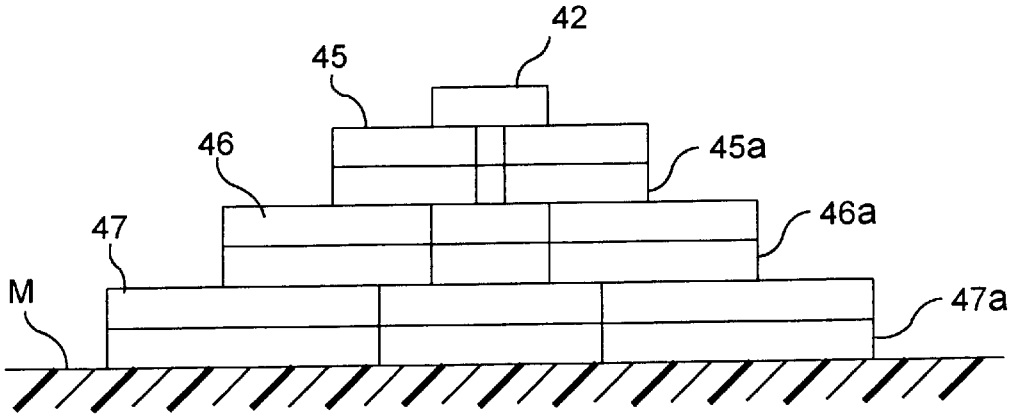
FIGS. 12B, 12C and 12D (the latter fragmentary) are views corresponding to FIG. 12A showing several modifications.
Figure 12C:
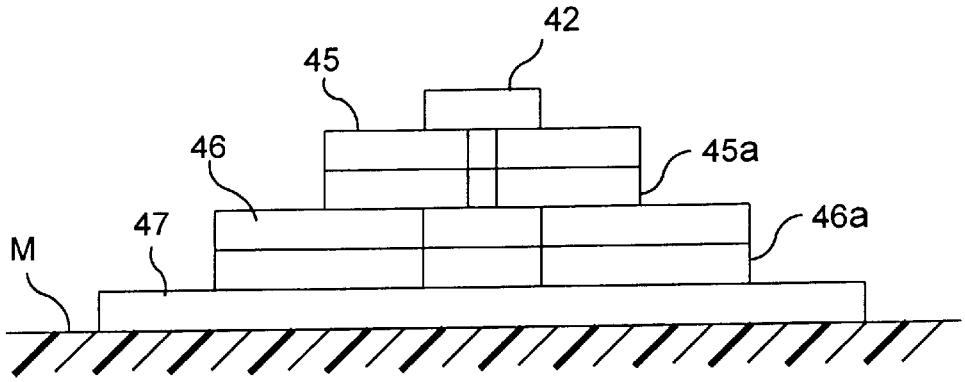
Figure 12D:
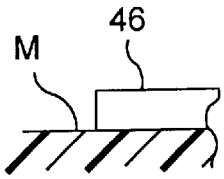

FIGS. 12B, 12C and 12D show optional first, second and third separators 45*a*, 46*a* and 47*a* and a support M.

Figure 13:
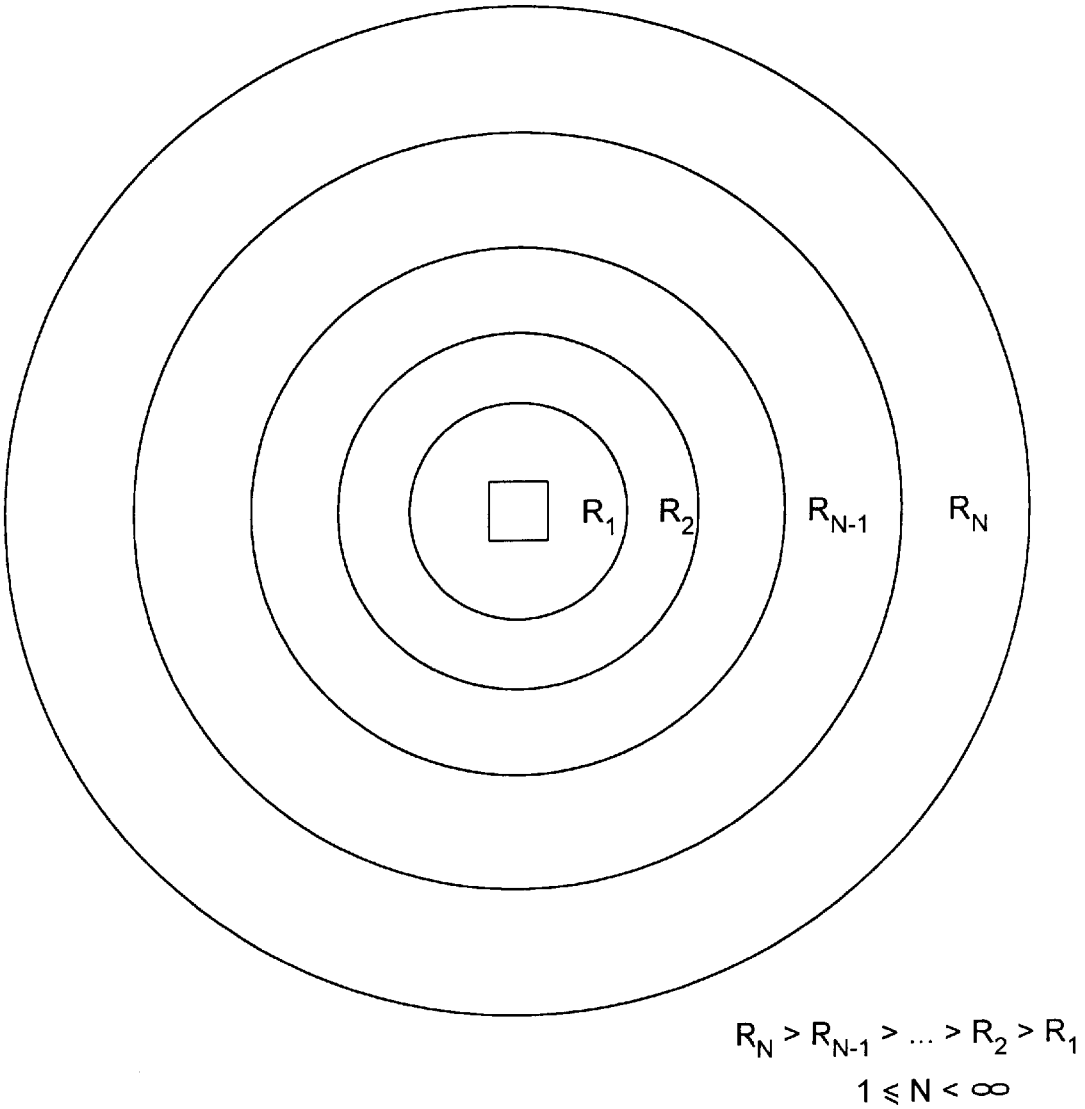
FIG. 13 is a fragmentary top view of another embodiment of antenna structure in accordance with the invention.

As FIG. 13 shows, any number of conductive layers can be employed. FIG. 13 illustrates conductive layers $R_1, R_2 \ldots R_{N-1}, R_N$. N can have any value equal to or greater than one.

Ideally, resistivity measured from the inner edge to the outer edge has a resistive profile varying in accordance with the following formula:

$$R=3+4.9881((\exp 1.258x)-1) \quad (1)$$

where R is resistivity in ohms per square and x is distance in inches measured form the inner to the outer edge of the ground plane. The graph is plotted in FIG. 14.

The conductive center of the ground plane is 4.97 inches square (about 12.6 cm square) and approximately covers the "hole" in the ground plane. From another standpoint, the ground plane extends radially out approximately from the edges of the conductive center of the ground plane.

If a patch is employed as the radiating element, its dimensions will depend on the dielectric. If air is the dielectric, the patch can be, say, 2 inches (about 5 cm) on a side. If a material of higher dielectric constant is employed, the size of the patch can be reduced to, say, 1.5 inches (about 3.8 cm) on a side.

Figure 14:
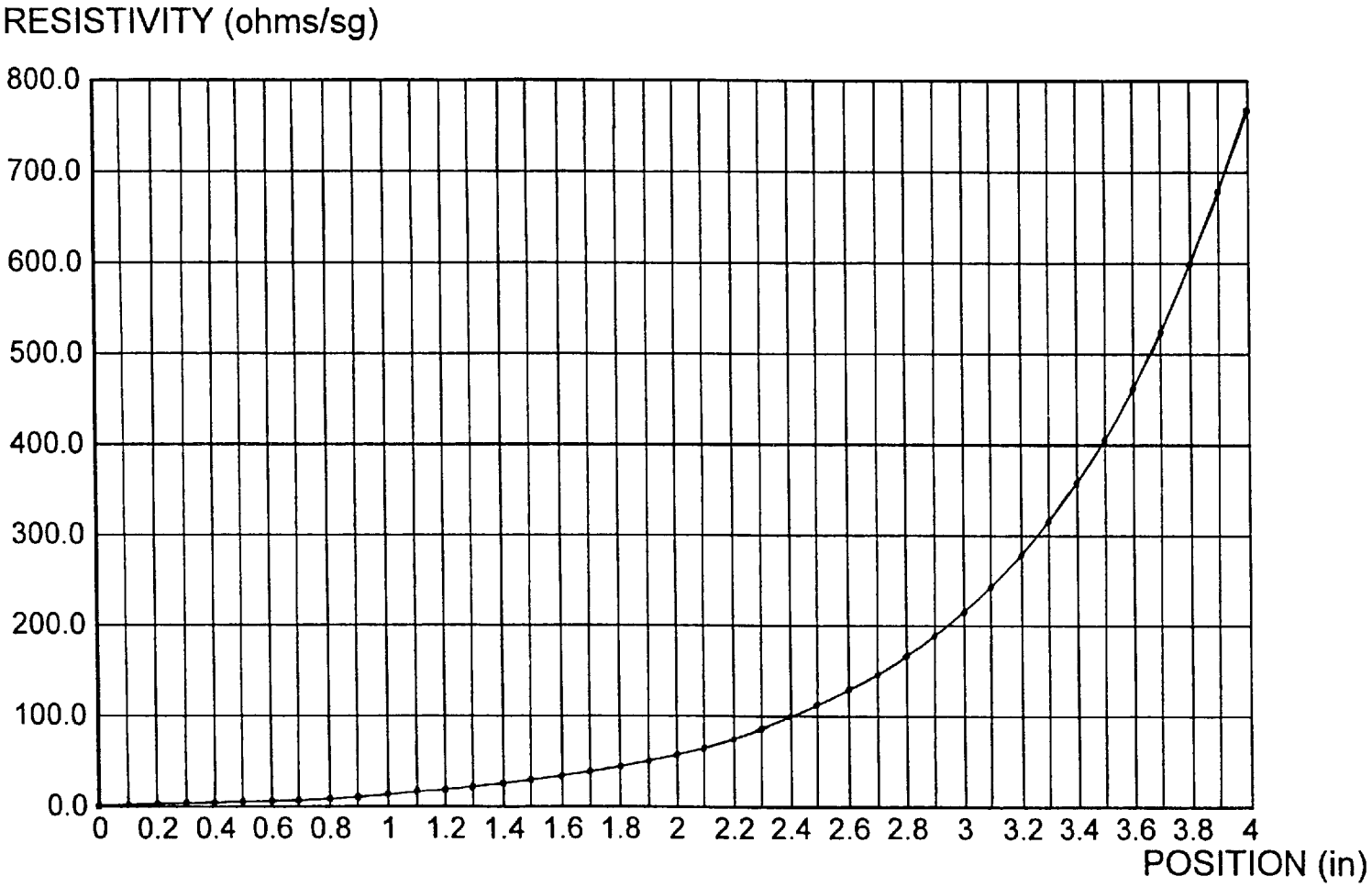
FIG. 14 is a graph showing the resistive profile of a ground plane employed in a preferred embodiment of the invention.

FIG. 14 shows the approximate resistivity profile of the ground plane for the preferred embodiment of the invention where N is large. In equation (1) above, consider for example a position 2.4 inches measured radially outward from the inner edge of the ground plane. The resistivity is calculated from equation (1) as follows:

$$1.258x=3.0192.$$

$$\exp 3.0192=20.475 \text{ (approximately)}$$

$$20.475-1=19.475$$

$$4.9881\times(19.475)=97.143 \text{ (approximately)}.$$

Finally, 3+97.143=100 (approximately), yielding the point (2.4, 100) as illustrated in FIG. 14. A similar calculation produces the other points on the graph.

Figure 15:
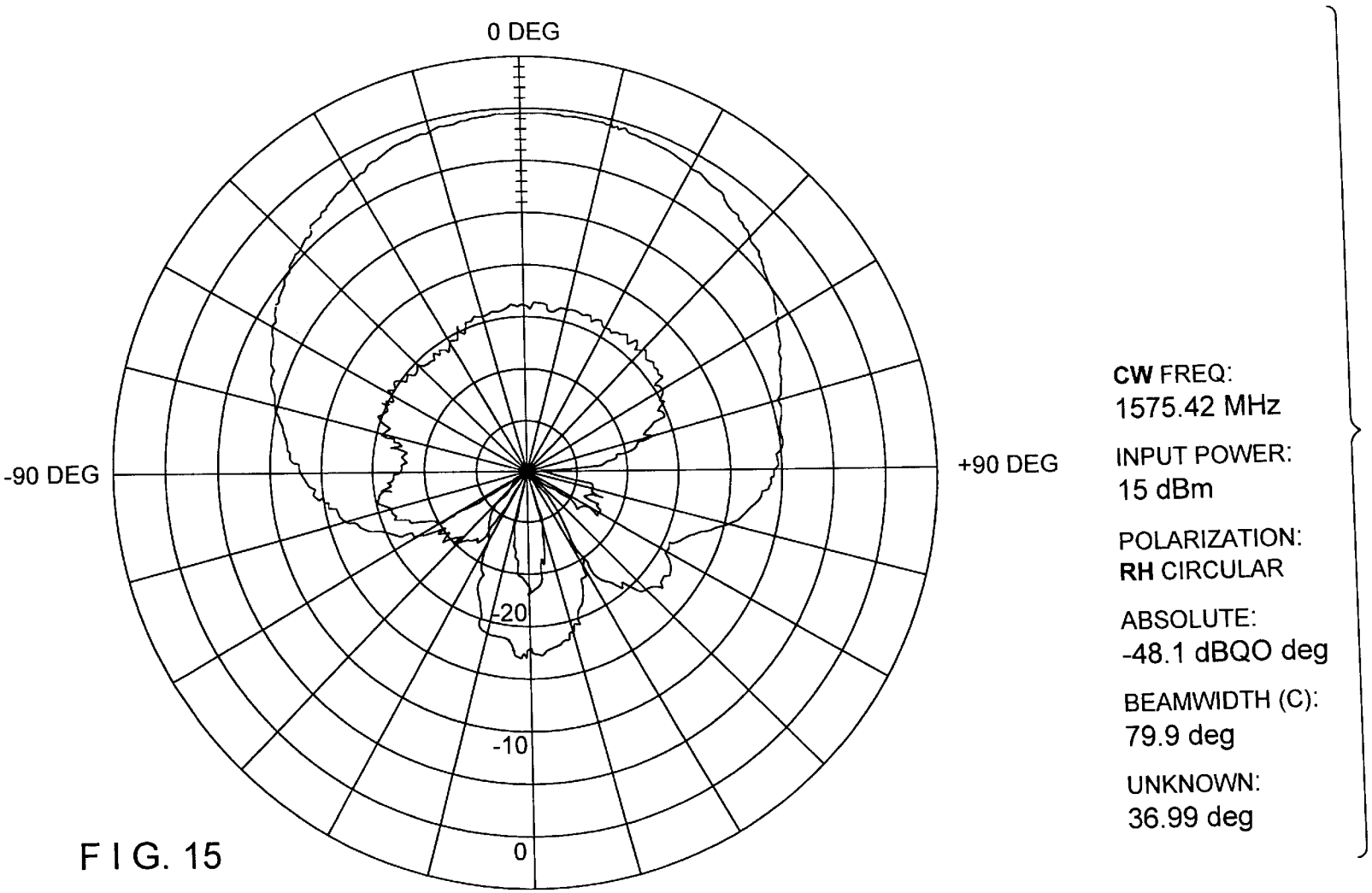
FIGS. 15–18 are plots illustrating an important advantage of the invention.
Figure 16:
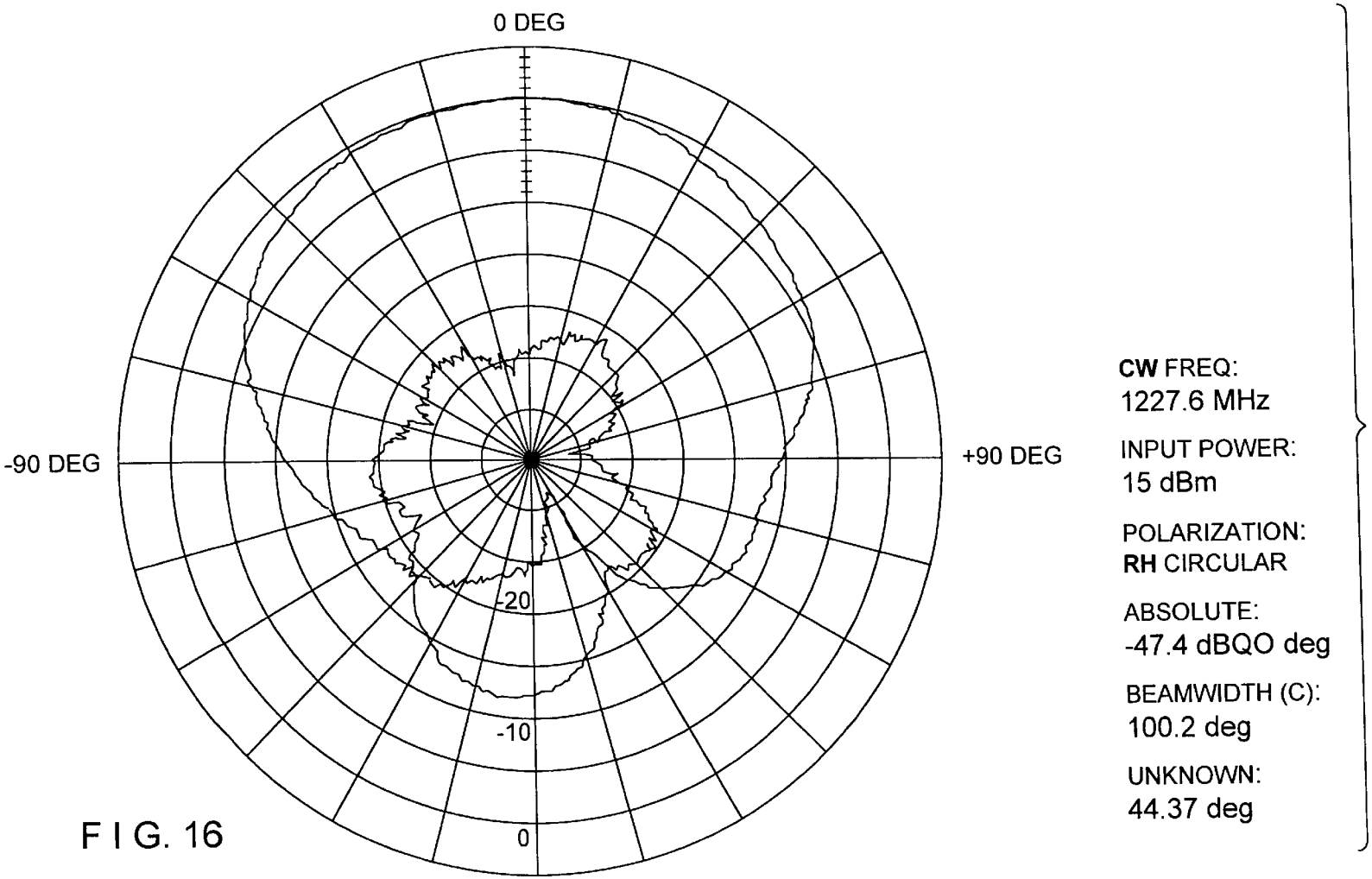
Figure 17:
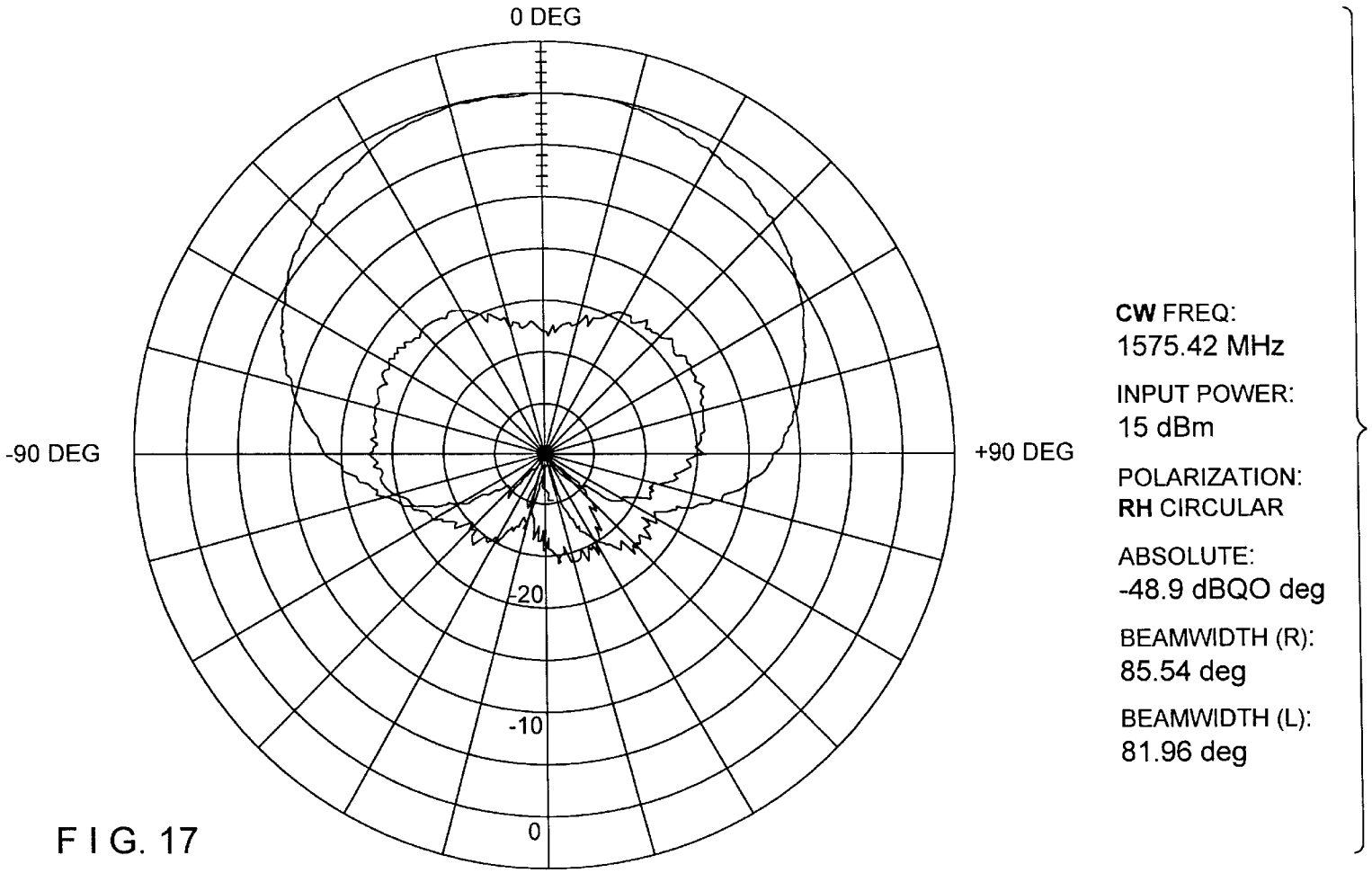
Figure 18:
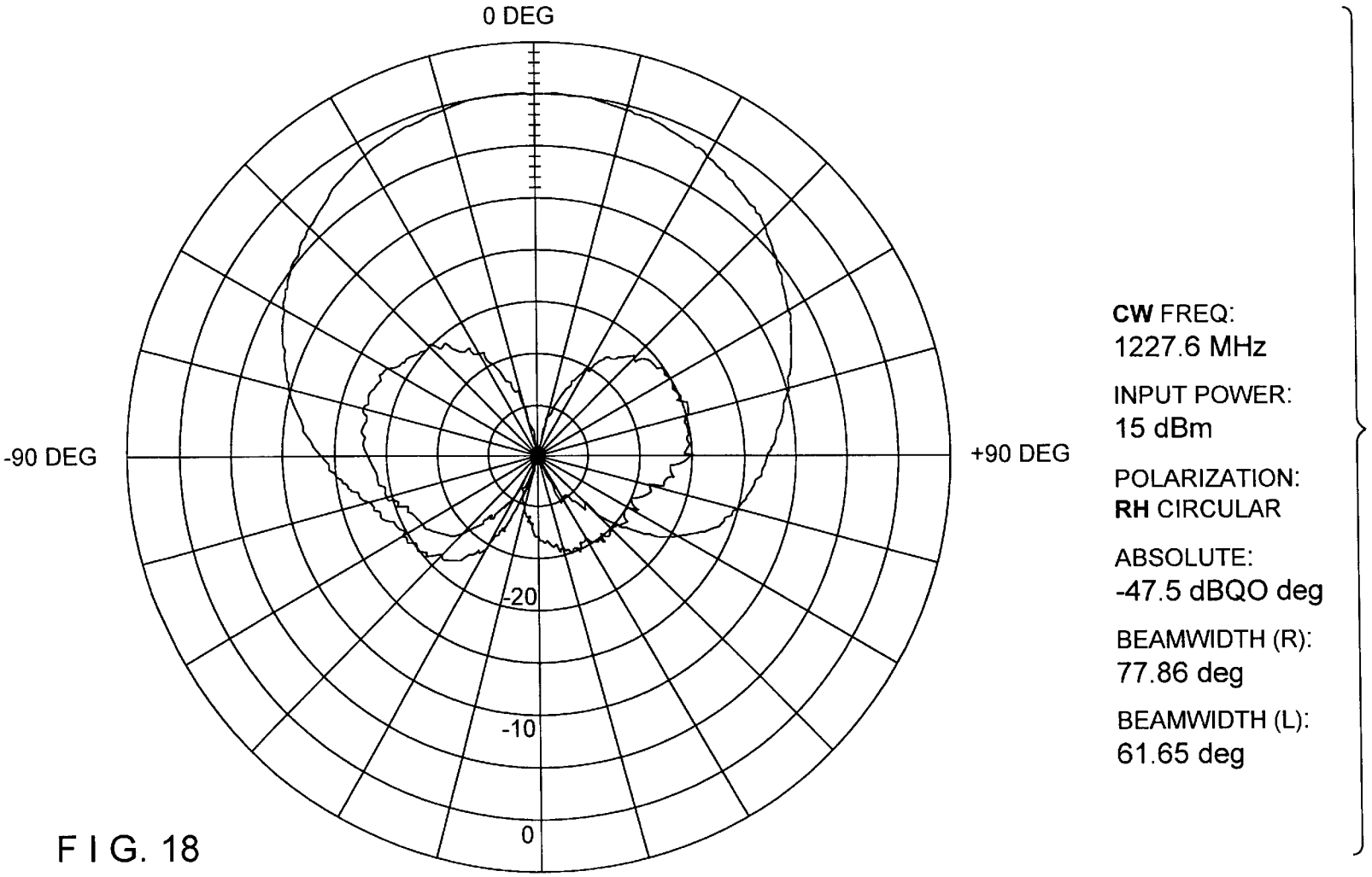

FIGS. 15 and 16 show the antenna pattern without a ground plane (at the two GPS frequencies). FIGS. 17 and 18 show the antenna pattern with a stacked resistive sheets ground plane (2 sheets: 80 ohms per square and 300 ohms per square at the two GPS frequencies). The important thing to notice is that the back lobes (the area under the curves on the bottom half of the plots) are reduced in FIGS. 17 and 18. The two lines on each plot represent the received signal strength of a right hand circular polarized (RHCP) signal and a left hand (LHCP) signal, corresponding to a GPS signal and a reflected signal.

The antenna structure described above reduces multipath signals caused by reflection from the earth. The ground plane, though physically small, simulates an infinite ground plane because of its varying sheet resistivity. Signals reflected from the ground and impinging on the underside of the antenna structure are absorbed by the ground plane and dissipated as heat; they do not interact substantially with the antenna proper. The antenna is particularly adapted for use in a GPS receiver that receives and processes signals from navigation satellites. Because of its light weight, it is suitable for hand-held units of the type used by surveyors.

While the preferred embodiments of the invention have been described above, many modifications thereof will readily occur to those skilled in the art upon consideration of this disclosure. The invention includes all subject matter that falls within the scope of the appended claims.

We claim:

1. An antenna structure comprising:

a radiating element and a ground plane for the radiating element having a central region closely spaced apart from the radiating element and a peripheral region extending away from the central region, wherein:

the peripheral region comprises a conductive layer that provides a sheet resistivity higher than that of the radiating element and extends radially beyond the radiating element and the ground plane has a sheet resistivity less than 3 ohms per square measured from dead center to the periphery of the radiating element and a sheet resistivity at least as high as that of free space measured at the periphery of the ground plane.

2. An antenna structure comprising:

a radiating element and a ground plane for the radiating element having a central region closely spaced apart from the radiating element and a peripheral region extending away from the central region, wherein:

the peripheral region comprises a first conductive layer that provides a sheet resistivity of a first value and a second conductive layer that extends radially beyond the first conductive layer to provide a sheet resistivity of a second value higher than the first value, and the ground plane has a sheet resistivity less than 3 ohms per square measured from dead center to the periphery of the radiating element and a sheet resistivity at least as high as that of free space measured at the periphery of the ground plane.

3. An antenna structure according to claim 2 wherein the radiating element comprises a patch antenna.

4. An antenna structure according to claim 2 wherein the radiating element and the ground plane have the same shape.

5. An antenna structure according to claim 2 wherein the radiating element and the ground plane are both square.

6. An antenna structure according to claim 2 wherein the radiating element and the ground plane are both circular.

7. An antenna structure according to claim 2 wherein the radiating element and the ground plane are both octagonal.

8. An antenna structure according to claim 2 wherein the radiating element and the ground plane have dissimilar shapes.

9. An antenna structure according to claim 2 wherein the radiating element is circular and the ground plane is square.

10. An antenna structure according to claim 2 wherein the radiating element is square and the ground plane is circular.

11. An antenna structure according to claim 2 wherein the radiating element is circular and the ground plane is octagonal.

12. An antenna structure according to claim 2 wherein the radiating element is square and the ground plane is octagonal.

13. An antenna structure according to claim 2 wherein the radiating element is centered over the ground plane.

14. An antenna structure according to claim 2 wherein the ground plane is planar.

15. An antenna structure according to claim 2 wherein the ground plane is frustoconical and concave up.

16. An antenna structure according to claim 2 wherein the ground plane is frustoconical and concave down.

17. An antenna structure according to claim 2 wherein the ground plane comprises a conductive disk in the central region.

18. An antenna structure according to claim 2 wherein the ground plane comprises a conductive disk in the central region that is at least in part metallic.

19. An antenna structure according to claim 2 wherein the ground plane comprises a conductive disk in the central region that is at least in part formed of aluminum.

20. An antenna structure according to claim 2 wherein the ground plane has a sheet resistivity less than 3 ohms per square measured from dead center to the periphery of the radiating element and a sheet resistivity much higher than that of free space measured at the periphery of the ground plane.

21. An antenna structure according to claim 2 wherein the sheet resistivity in the peripheral region exceeds that in the central region by several orders of magnitude, whereby the ground plane simulates an infinite ground plane.

22. An antenna structure comprising:

a radiating element and a ground plane for the radiating element having a central region closely spaced apart from the radiating element and a peripheral region extending away from the central region, wherein:

the peripheral region comprises first and second conductive layers that in part overlap to provide a sheet resistivity of a first value, the second conductive layer extends radially beyond the first conductive layer to provide a sheet resistivity of a second value higher than the first value, and the ground plane has a sheet resistivity less than 3 ohms per square measured from dead center to the periphery of the radiating element and a sheet resistivity at least as high as that of free space measured at the periphery of the ground plane.

23. An antenna structure according to claim 22 further comprising a first separating layer between the first and second conductive layers.

24. An antenna structure according to claim 23 wherein the first separating layer comprises a plastic.

25. An antenna structure according to claim 23 wherein the first separating layer comprises an adhesive.

26. An antenna structure according to claim 22 further comprising a mount connected to and supporting the second conductive layer.

27. An antenna structure according to claim 26 wherein the mount is made of plastic.

28. An antenna structure according to claim 27 wherein the plastic is ABS.

29. An antenna structure comprising:

a radiating element and a ground plane for the radiating element having a central region closely spaced apart from the radiating element and a peripheral region extending away from the central region, wherein:

the peripheral region comprises first, second and third conductive layers that in part overlap to provide a sheet resistivity of a first value, the second and third conductive layers extend radially beyond the first conductive layer and in part overlap to provide a sheet resistivity of a second value higher than the first value, and the third conductive layer extends radially beyond the second conductive layer to provide a sheet resistivity of a third value higher than the second value.

30. An antenna structure according to claim 29 further comprising a first separating layer between the first and second conductive layers and a second separating layer between the second and third conductive layers.

31. An antenna structure according to claim 30 wherein the first separating layer is conductive.

32. An antenna structure according to claim 30 wherein the first separating layer is nonconductive.

33. An antenna structure according to claim 29 further comprising a mount connected to and supporting the third conductive layer.

34. An antenna structure according to claim 33 wherein the mount is made of plastic.

35. An antenna structure according to claim 34 wherein the plastic is ABS.

36. An antenna structure according to claim 33 further comprising a third separating layer between the third conductive layer and the mount.

37. An antenna structure according to claim 36 wherein the third separating layer comprises a plastic.

38. An antenna structure according to claim 36 wherein the third separating layer comprises an adhesive.

39. An antenna structure according to claim 36 wherein the third separating layer is conductive.

40. An antenna structure according to claim 36 wherein the third separating layer is nonconductive.

41. An antenna structure according to claim 29 wherein the first, second and third conductive layers are respectively formed as first, second and third disks each having a central aperture.

42. An antenna structure according to claim 41 wherein the disks are mounted concentrically.

43. An antenna structure according to claim 42 wherein each central aperture has a diameter of about 4 inches, the first disk has a diameter of about 8 inches, the second disk has a diameter of about 10 inches, the third disk has a diameter of about 12 inches, and each disk has a thickness of about 1 to 15 microns.

44. An antenna structure comprising:

a radiating element and a ground plane for the radiating element having a central region closely spaced apart from the radiating element and a peripheral region extending away from the central region, wherein:

the peripheral region comprises first and second conductive layers that in part overlap to provide a sheet resistivity of a first value, and the second conductive layer extends radially beyond the first conductive layer to provide a sheet resistivity of a second value higher than the first value; and the ground plane has a sheet resistivity less than 3 ohms per square measured from dead center to the periphery of the radiating element and a sheet resistivity at least as high as that of free space measured at the periphery of the ground plane; further comprising a mount connected to and supporting the second conductive layer, a first separating layer between the first and second conductive layers, and a second separating layer between the second conductive layer and the mount.

45. An antenna structure comprising:

a radiating element and a ground plane for the radiating element having a central region closely spaced apart from the radiating element and a peripheral region extending away from the central region, wherein:

the peripheral region comprises first and second conductive layers that in part overlap to provide a sheet resistivity of a first value, and the second conductive layer extends radially beyond the first conductive layer to provide a sheet resistivity of a second value higher than the first value; further comprising a mount connected to and supporting the second conductive layer, a first separating layer between the first and second conductive layers, and a second separating layer between the second conductive layer and the mount;

wherein the first and second conductive layers are respectively formed as first and second disks each having a central aperture.

46. An antenna structure according to claim 45 wherein the disks are mounted concentrically.

47. An antenna structure according to claim 26 wherein each central aperture has a diameter of about 4 inches, the first disk has a diameter of about 10 inches, the second disk has a diameter of about 12 inches, and each disk has a thickness of about 1 to 15 microns.

48. A method comprising the steps of:

forming an antenna structure comprising:

a radiating element for receiving broadcast signals directly and, because of reflection of the signals, also indirectly with a time delay, and a ground plane, wherein:

the ground plane has a central region closely spaced apart from the radiating element and a peripheral region extending away from the central region, the peripheral region comprises a first conductive layer that provides a sheet resistivity higher than that of the radiating element and extends radially beyond the radiating element; and the ground plane has a sheet resistivity less than 3 ohms per square measured from dead center to the periphery of the radiating element and a sheet resistivity at least as high as that of free space measured at the periphery of the ground plane; and employing the antenna structure to receive the broadcast signals;

whereby the signals received indirectly because of reflection are attenuated.

49. A method according to claim 48 wherein the signals are broadcast by navigation satellites.

50. A method according to claim 48 wherein the signals are GPS signals.

* * * * *